United States Patent [19]

Grant et al.

[11] 3,953,567

[45] Apr. 27, 1976

[54] $^{82}$Sr-$^{82}$Rb RADIOISOTOPE GENERATOR

[75] Inventors: Patrick M. Grant; Bruce R. Erdal; Harold A. O'Brien, all of Los Alamos, N. Mex.

[73] Assignee: The United States of America as represented by the United States Energy Research and Development Administration, Washington, D.C.

[22] Filed: Sept. 27, 1974

[21] Appl. No.: 509,991

[52] U.S. Cl. ..... 423/2; 252/301.1 R; 423/249

[51] Int. Cl.$^2$ ..... C22B 26/10

[58] Field of Search ..... 252/301.1 R, 301.15; 260/2.2 R; 423/249, 2

[56] References Cited

UNITED STATES PATENTS 3,554,709 1/1971 Orlandini et al. ..... 423/2

OTHER PUBLICATIONS

Chem. Abstracts, Vol. 64 (1966), No. 872b.
Chem. Abstracts, Vol. 67 (1967), No. 25274p.
Chem. Abstracts, Vol. 69 (1968), No. 48491n.
Yano, Y. et al., "Visualization . . . Camera," J. Nucl. Med., Vol. 9, (1968) pp. 412–415.
Zsinka et al., "Possibility . . . Strontium," Radiokhimiya, 1970, 12(5) pp. 774–778, as abstracted in Chem. Abstracts, No. 74:59759k.

*Primary Examiner*—Benjamin R. Padgett
*Assistant Examiner*—Deborah L. Kyle
*Attorney, Agent, or Firm*—Dean E. Carlson; Paul D. Gaetjens

[57] ABSTRACT

An improved $^{82}$Sr-$^{82}$Rb radioisotope generator system, based upon the complexing ion exchange resin Chelex-100, has been developed. Columns of this material can be easily and rapidly milked, and the Rb-Sr separation factor for a fresh generator was found to be $> 10^7$. Approximately 80 percent of the $^{82}$Rb present was delivered in a 15-ml volume of aqueous 0.2 M $NH_4Cl$ solution. After more than 6 liters of eluant had been put through the generator, the Rb-Sr separation factor was still observed to be $> 10^5$, and no unusual strontium breakthrough behavior was seen in the system over nearly three $^{82}$Sr half lives.

2 Claims, No Drawings

$^{82}$SR-$^{82}$RB RADIOISOTOPE GENERATOR

BACKGROUND OF THE INVENTION

1. Field of the Invention

Full-scale operation of the Clinton P. Anderson Meson Physics Facility at the Los Alamos Scientific Laboratory will provide significant quantities of 25-day $^{82}$Sr for clinical investigation. The short-lived daughter, 75-second $^{82}$Rb, is of value in biomedicine for circulation and perfusion studies as well as for myocardial imaging. A radiochemical separation procedure for the quantitative recovery and purification of spallation-produced $^{82}$Sr from proton-irradiated molybdenum targets has recently been developed. (See copending application entitled "Chemical Isolation of $^{82}$Sr from Proton-Irradiated Mo Targets" by Patrick M. Grant et al.)

The existence of a suitable $^{82}$Sr-$^{82}$Rb isotope generator is crucial to the utility of this radionuclidic system in nuclear medicine. While many effective strontium-rubidium separations have been implemented in such diverse fields as fission research, geochemical and cosmochemical chronology studies, and isotope production, few methods satisfy the stringent requirements of a potential biomedical radioisotope generator:

1. The system should be simple to operate.
2. Near-quantitative $^{82}$Rb yields should be obtained from the generator with each milking to maximize the system efficiency.
3. The generator must have extremely low strontium breakthrough per elution to minimize the amount of long-lived, boneseeking radiostrontium activities administered to the patient. Conditions 2 and 3 taken together denote a large Rb-Sr separation factor.
4. The generator milking time should be short in comparison with the $^{82}$Rb half life. This keeps the amount of in situ $^{82}$Rb decay small and therefore the effective overall $^{82}$Rb yield high.
5. The generator eluant must be compatible with biological systems or have the potential to be easily and rapidly made so. The very short half life of $^{82}$Rb precludes the performance of any detailed post-elution chemistry in the interest of efficient radiorubidium yields.
6. The system should have sufficient stability on a time scale of several $^{82}$Sr half lives to allow repetitive usage and a reasonable shelf life.

2. Prior Art

The only $^{82}$Sr-$^{82}$Rb biomedical generators of which the inventors are aware are systems that employ the weakly acidic cation-exchange resin, carrier-free $^{82}$Sr, and an automatic elution system for intravenous infusion. (Y. Yano and H. O. Anger, Journal of Nuclear Medicine 9: 412–415, 1968.) One generator uses varying strengths of ammonium acetate ($NH_4C_2H_3O_2$) solution as the eluant, but it is restricted to concentrations $\leq$ 0.4 M because of the toxicity of the acetate compound. The Rb-Sr separation factor for a fresh generator is $10^4$, but passage of 400 ml of 0.3 M $NH_4C_2H_3O_2$ through the column reduces this value to $10^2$, and the $^{82}$Rb yield in a 20-ml elution is only 56 percent. Another generator elutes the $^{82}$Sr-loaded column with a 3 percent NaCl solution. This system exhibits a $10^5$ maximum Rb-Sr separation factor, no significant increase in strontium leakage with up to 600 ml of eluant, and a $^{82}$Rb elution yield of 62 percent.

SUMMARY OF THE INVENTION

The inventors have improved upon the prior-art generators by making use of the chemical fact that the alkali metal elements rarely, if ever, form coordination complexes. Moreover, previous work on the retention of calcium on a chelating exchanger demonstrated that distribution coefficients $> 10^4$ could be obtained for alkaline earths in solutions of high pH and low ionic strength. The behavioral similarity of calcium and strontium on a chelating resin as well as the expectation of a lack of rubidium interaction led to the development of the radioisotope generator of this invention based upon the ion exchange resin Chelex-100. The inventors define Chelex-100 for the purpose of this invention as an ion exchange resin prepared by chemically attaching iminodiacetate exchange groups to a styrene-divinylbenzene copolymer lattice.

DESCRIPTION OF THE PREFERRED EMBODIMENT

A glass column of 1.1 cm i.d. is filled to a height of approximately 6–6.5 cm with 100–200 mesh Chelex-100 analytical grade resin. The resin is slurried into the columns with a pH 9.3–9.4 buffer solution of 0.1 M $NH_4OH$ + 0.1 M $NH_4Cl$, and this same solution is used as the generator eluant for the subsequent milking of $^{82}$Rb. The flow rate for column loadings is maintained at ~ 0.5–1 ml/min.

The weakly acidic final solutions from several Mo-$^{82}$Sr radiochemical separations were combined, adjusted to pH ~ 9.5 with concentrated $NH_4OH$, and diluted to 100-150 ml with distilled water. This solution was then charged onto a Chelex-100 column. Successive elutions were performed with the $NH_4OH$-$NH_4Cl$ buffer at a flow rate of ~ 1 ml/sec, and a 25-ml eluant volume was found to be sufficient for quantitative $^{82}$Rb elutions under these conditions. A total of 2600 ml was passed through this column to determine the strontium breakthrough characteristics, with 20 independent 25-ml eluant volumes being sampled at various points to measure $^{82}$Rb yields. The radiostrontium activities present in the method of this invention were assayed to be approximately 0.5 $\mu$Ci $^{82}$Sr and 5 $\mu$Ci $^{85}$Sr.

In the preferred embodiment the 20 independent elutions to measure $^{82}$Rb yield gave an average value of 102 ± 3 percent radiorubidium off the column in a 25-ml volume. The measured $^{82}$Rb counting data were decay-corrected to the start of elution to obtain this percentage, however, and the practical $^{82}$Rb generator yield (the amount capable of being administered to a patient) must also reflect the decay of the isotope during transit of the column. It was determined that 90–95 percent of the total activity can be found in the 15-ml eluant volume between 5 and 20 ml. At a flow rate of 1 ml/sec, therefore, it will take 20 seconds to pass 20 ml through the generator, and this will give rise to a 17 percent $^{82}$Rb decay factor. As a result, the effective $^{82}$Rb yield from this column would be approximately 80 percent.

To more realistically determine strontium breakthrough for the generator system of this invention, a second experiment was performed in which 10 mCi of commercially-obtained $^{85}$Sr was introduced onto a fresh Chelex column (again, after pH adjustment to ~ 9.5 and dilution). More than 6 liters of the eluant buffer were then passed through the resin at flow rates of 0.6–0.8 ml/sec, and 25-ml volumes were collected periodically to measure their radiostrontium content.

This 10 mCi of commercially-produced $^{85}Sr$ contained approximately 0.8 mg of stable strontium carrier, an amount very close to what will be generated in the eventual Clinton P. Anderson Meson Physics Facility product through nuclear interactions. Consequently, the strontium breakthrough results obtained with this activity are a good indication of the performance of the Chelex generator under practical column-loading experimental conditions. The Rb-Sr separation factor for a fresh generator was observed to be $> 10^7$, and, even after more than 6 liters of eluant had been passed through the column, this variable was still $> 10^5$. In addition, over a period of nearly three $^{82}Sr$ half lives, no perceptible deviation of the strontium breakthrough from a linear behavior was noted (an indication of long-term system stability).

Chelex-100 resin has been used as the basis of a new $^{82}Sr$-$^{82}Rb$ radioisotope generator. Under the conditions described in this application, the Rb-Sr separation factor for a fresh system is $> 10^7$, and the useful $^{82}Rb$ yield off the column is approximately 80 percent. A post-elution neutralization of the eluant with a small volume of a concentrated HCl solution would make the $^{82}Rb$-containing fluid more physiologically tolerable and would allow injection of essentially a 0.2 M $NH_4Cl$ solution. The generator elution is rapid, repetitive, and easy to perform. In accordance with the laws of radioactive secular equilibrium, quantitative $^{82}Rb$ elutions can be performed every ten minutes or so.

More than 6 liters of eluant could be passed through the system described here without decreasing the Rb-Sr separation factor below $10^5$. Should strontium breakthrough become unacceptable, however, it is a simple procedure to quantitatively strip the radiostrontium from the resin with a few column volumes of 1 M HCl, adjust the pH and ionic strength as discussed above, and prepare a fresh Chelex generator. In this regard, one should be aware of the cautions concerning Chelex-100 swelling and the storing of the resin in the hydrogen form.

System parameters such as strontium breakthrough and delivery volume are very sensitive to adjustable variables like column dimensions, flow rate, resin size, temperature, and, for chelating resins, pH. For example, employing longer and thinner columns, slower flow rates, eluants with a higher pH, or perhaps a mixed water-ethanol medium may improve the strontium breakthrough characteristics. Using the concepts of this invention, one can easily design systems to meet specific requirements of $^{82}Rb$ yield, delivery volume, etc.

In comparing our results with the performance of other $^{82}Sr$-$^{82}Rb$ generators, it should be remembered that previous work employed carrier-free $^{82}Sr$ while our experiment utilized a minimum of 0.8 mg of stable strontium. It is expected that the performance characteristics of our macroscopically-loaded column experiments would be considerably improved if conducted in the carrier-free mode.

What we claim is:

1. An improved method of generating $^{82}Rb$ with a separation factor of at least $10^5$ in respect to radioactive $^{82}Sr$ and having yields of about 80 percent comprising:

a. preparing an ion exchange column resin consisting of a 100–200 mesh resin which is composed of a styrenedivinylbenzene copolymer with attached iminodiacetate exchange groups, b. charging the said ion exchange column with a basic solution containing $^{82}Sr$, and c. eluting the $^{82}Rb$ from the said column using a 0.1 molar ammonium hydroxide-ammonium chloride buffered solution.

2. The method of claim 1 wherein the eluant of step (c) is about 25 ml by volume.

* * * * *